US005282594A

United States Patent [19]

Huang

[11] Patent Number: 5,282,594

[45] Date of Patent: Feb. 1, 1994

[54] LASER SIGHT MOUNTING DEVICE

[76] Inventor: Chao C. Huang, 10F, No. 185, Yung Chi Rd., Taipei, Taiwan

[21] Appl. No.: 63,827

[22] Filed: May 20, 1993

[51] Int. Cl.[5] ..... A47B 96/06

[52] U.S. Cl. ..... 248/205.1; 33/233; 42/100

[58] Field of Search ..... 248/200, 205.1; 42/100; 33/233, 241, 258, 257

[56] References Cited

U.S. PATENT DOCUMENTS

| | | | |
|---|---|---|---|
| 3,424,420 | 1/1969 | Seiderman | 42/101 X |
| 3,463,430 | 8/1969 | Rubin | 42/101 X |
| 3,734,437 | 5/1973 | Underwood | 248/205.1 |
| 3,875,675 | 4/1975 | Krisay | 33/245 |
| 3,880,389 | 4/1975 | Burris | 248/205.1 |
| 4,085,511 | 4/1978 | Kovac | 33/250 |
| 4,679,344 | 7/1987 | Jolly | 33/233 X |
| 4,742,635 | 5/1988 | Ruger | 42/100 |
| 4,945,667 | 8/1990 | Rogalski | 33/241 X |
| 5,095,643 | 3/1992 | Fisher | 42/100 X |

*Primary Examiner*—J. Franklin Foss

*Attorney, Agent, or Firm*—Lowe, Price, LeBlanc & Becker

[57] ABSTRACT

A laser sight mounting device fastened to the trigger guard of a gun to hold a laser sight. The mounting device includes a mount having a gap defined between an arched block and a L-shaped frame thereof for receiving the trigger guard of a gun, a connecting plate fastened between the arched block and the L-shaped frame to retain the mount to the trigger guard, tightening up screw rods threaded into respective screw holes on the L-shaped frame against the trigger guard and tightened by respective locknuts to fix the mount in position, and a laser holder having a channel fastened to the L-shaped frame by screws and a hollow split cylinder controlled by an adjusting screw for mounting a laser sight.

2 Claims, 5 Drawing Sheets

LASER SIGHT MOUNTING DEVICE

BACKGROUND OF THE INVENTION

The present invention relates to a mounting device for detachably mounting a laser sight on a gun, optical instrument, etc.

A variety of laser sights are known and widely used to aid the eyes in lining up a gun, optical instrument, etc. on its objective. Various mounting devices have been disclosed for mounting a laser sight on a gun, optical instrument, etc. However, these laser sight mounting devices are commonly heavy, and complicated to install. If a laser sight is fastened to a gun by a conventional laser sight mounting device, the laser sight mounting device with the laser sight may be shaken to shift upon the discharge of the gun, and heat may be transmitted from the gun barrel to the laser sight, causing damage of the laser diode.

SUMMARY OF THE INVENTION

The present invention has been accomplished under the aforesaid circumstances. It is therefore an object of the present invention to provide a laser sight mounting device which is easy to install. Another object of the present invention is to provide a laser sight mounting device which eliminates the transmission of shock waves from the gun barrel to the laser sight. Still another object of the present invention is to provide a laser sight mounting device which is inexpensive to manufacture. These objects are achieved by fastening the laser sight mounting device to the trigger guard of a gun and spacing it from the gun barrel. The present invention uses a connecting plate to fasten a mount to the trigger guard of a gun, and then uses tightening up screws and locknuts to fix the mount in position. A laser sight holder is fastened to the mount by screws for hold a laser sight. An adjusting screw is threaded into screw holes on the laser sight holder to adjust the pitch on the split front end of a hollow cylinder of the laser sight holder so that a laser sight can be conveniently fastened to the laser sight holder and then dismantled from the laser sight holder when a repair work is needed.

DETAILED DESCRIPTION OF THE PREFERRED EMBODIMENT

Figure 1:
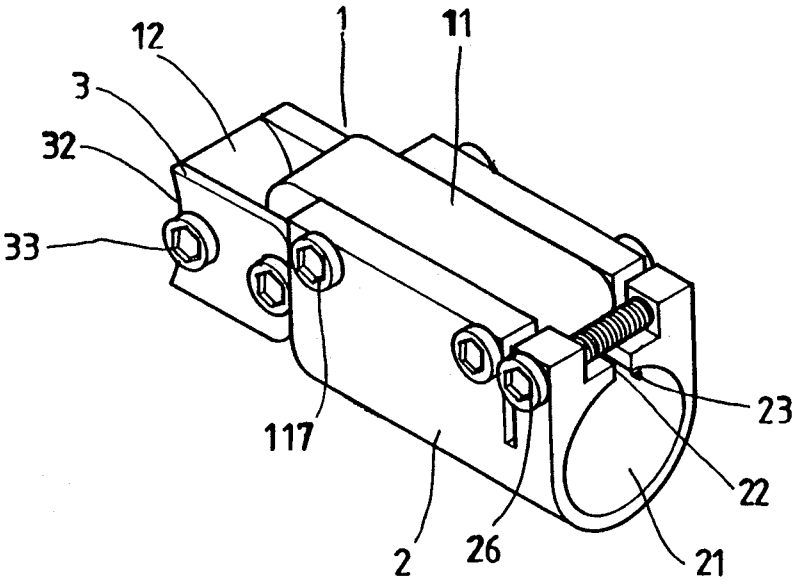
FIG. 1 is a perspective elevational view of a laser sight mounting device according to the preferred embodiment of the present invention.
Figure 2:
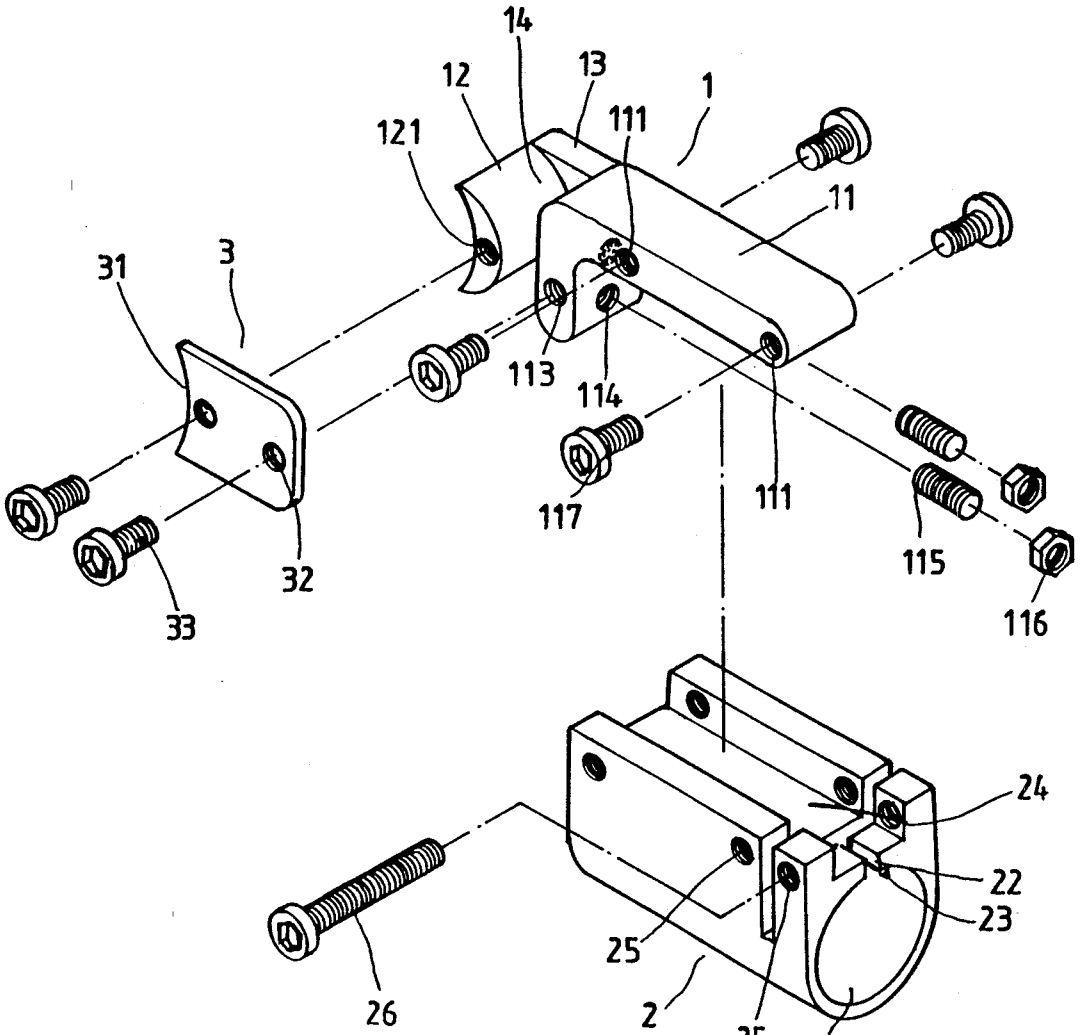
FIG. 2 is a perspective exploded view of the laser sight mounting device.

Referring to FIGS. 1 and 2, a laser sight mounting device in accordance with the present invention is generally comprised of a mount 1, a laser sight holder 2, and a connecting plate 3.

The mount 1 comprises a L-shaped frame 11, an arched block 12 spaced from the L-shaped frame 11 by a gap 14, and a connecting frame 13 connected between the arched block 12 and the L-shaped frame 11 at one side. The L-shaped frame 11 comprises a longer horizontal wall and a shorter vertical wall extended from the longer horizontal wall at one end at right angles. The longer horizontal wall of the L-shaped frame has spaced screw holes 111 in the transverse direction (through the width of the longer horizontal wall). The shorter vertical wall of the L-shaped frame has two vertically spaced screw holes 114 in the longitudinal direction (through the width of the shorter vertical wall), and a screw hole 113 in the transverse direction (through the thickness of the shorter vertical wall). The arched block 12 has a screw hole 121 in the transverse direction (through the width of the arched block).

The laser sight holder 2 comprises a hollow cylinder 21 having a cut 22 at one end in the longitudinal direction and a groove 23 on the inside in the radial direction crossed over the cut 22, a channel 24 along the length of the hollow cylinder, and three spaced pairs of screw holes 25 in the transverse direction. An adjusting screw 26 is threaded into the first pair of screw holes 25 on the laser sight holder 2 and rotated in either direction to control the pitch of the cut 22, and therefore a laser sight can be conveniently and firmly installed in the hollow cylinder 21 of the laser sight holder 2. By threading respective screws 117 from the other two pairs of screw holes 25 into the screw holes 111 on the longer horizontal wall of the L-shaped frame 11, the L-shaped frame 11 of the mount 1 is fastened to the laser sight holder 2 and firmly retained in the channel 24.

The connecting plate 3 has two screw holes 32 respectively connected to the screw hole 121 on the arched block 12 and the transverse screw hole 113 on the shorter vertical wall of the L-shaped frame 11 by screws 33. When connected, the straight front end of the connecting plate 3 is abutted against the laser sight holder 2, and the curved rear end 31 of the connecting plate 3 is disposed in a flush manner with the arched block 12.

Figure 3:
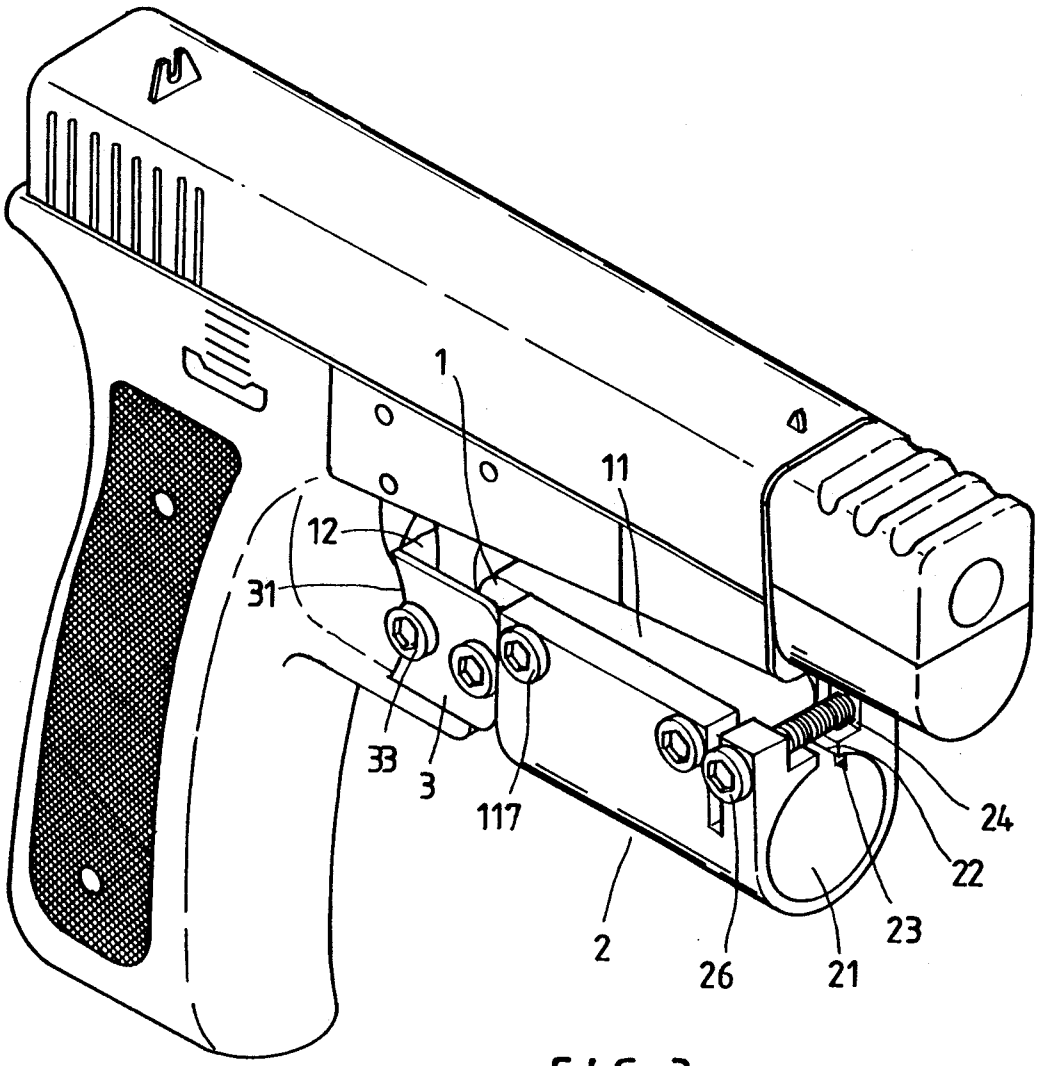
FIG. 3 is an installed view showing the laser sight mounting device fastened to a gun.

Referring to FIGS. 3 and 2 again, the mount 1 can be conveniently fastened to the trigger guard of a gun by inserting the trigger guard into the gap 14 between the arched block 12 and the L-shaped frame 11, then fastening the connecting plate 3 to the arched block 12 and the L-shaped frame 11, and then threading screw rods 115 into the vertically spaced screw holes 114 on the shorter vertical wall of the L-shaped frame 11, and then mounting locknuts 116 on the screw rods 115 to tighten the screw rods 115 against the trigger guard of the gun. When fixed, the laser sight holder 2 is fastened to the mount 1 according to the aforesaid procedure.

Figure 4:
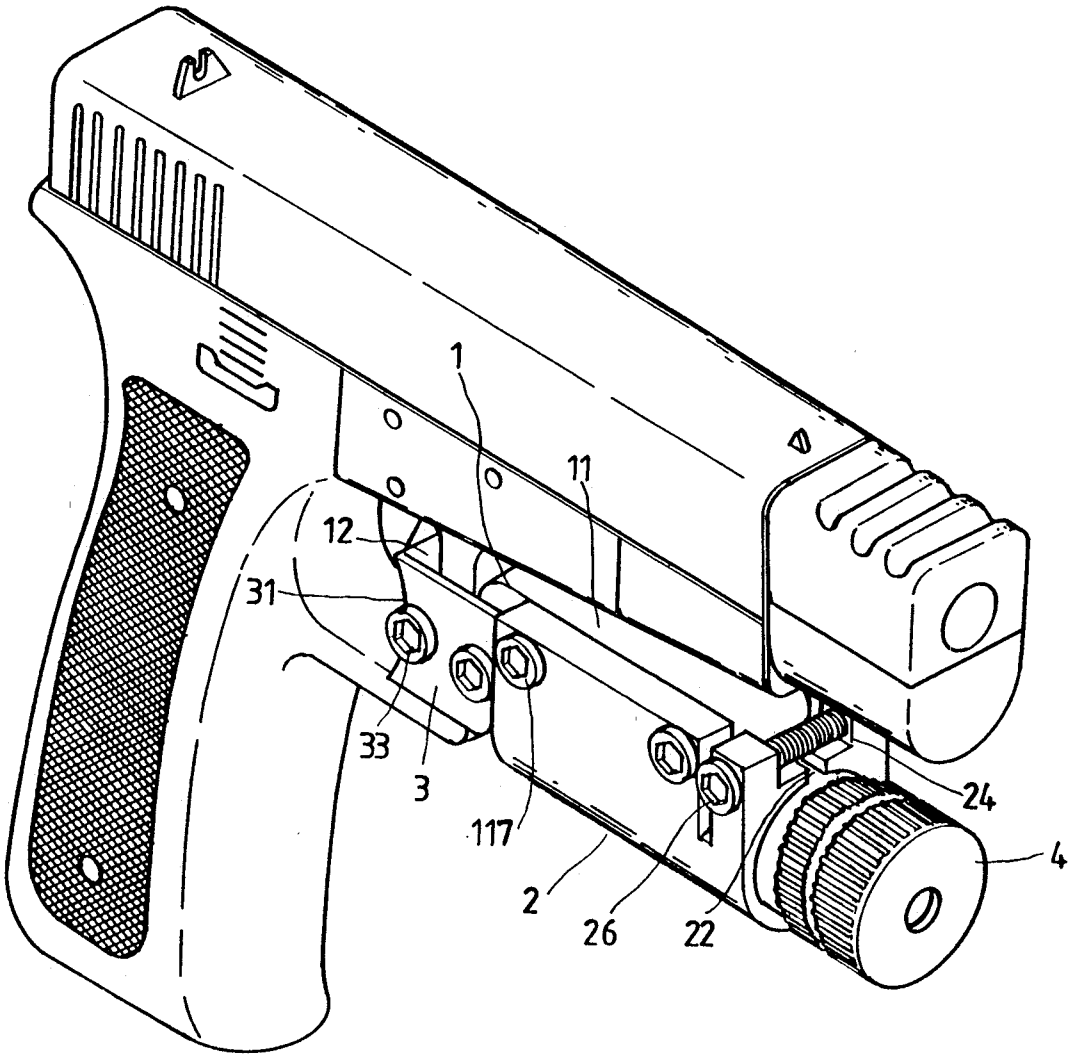
FIG. 4 is similar to FIG. 3 but showing a laser sight fastened to the laser sight mounting device.

Referring to FIG. 4, by turning the adjusting screw 26 in either direction, the pitch of the cut 22 is adjusted for mounting a laser sight 4 on the laser sight holder 2.

Figure 5:
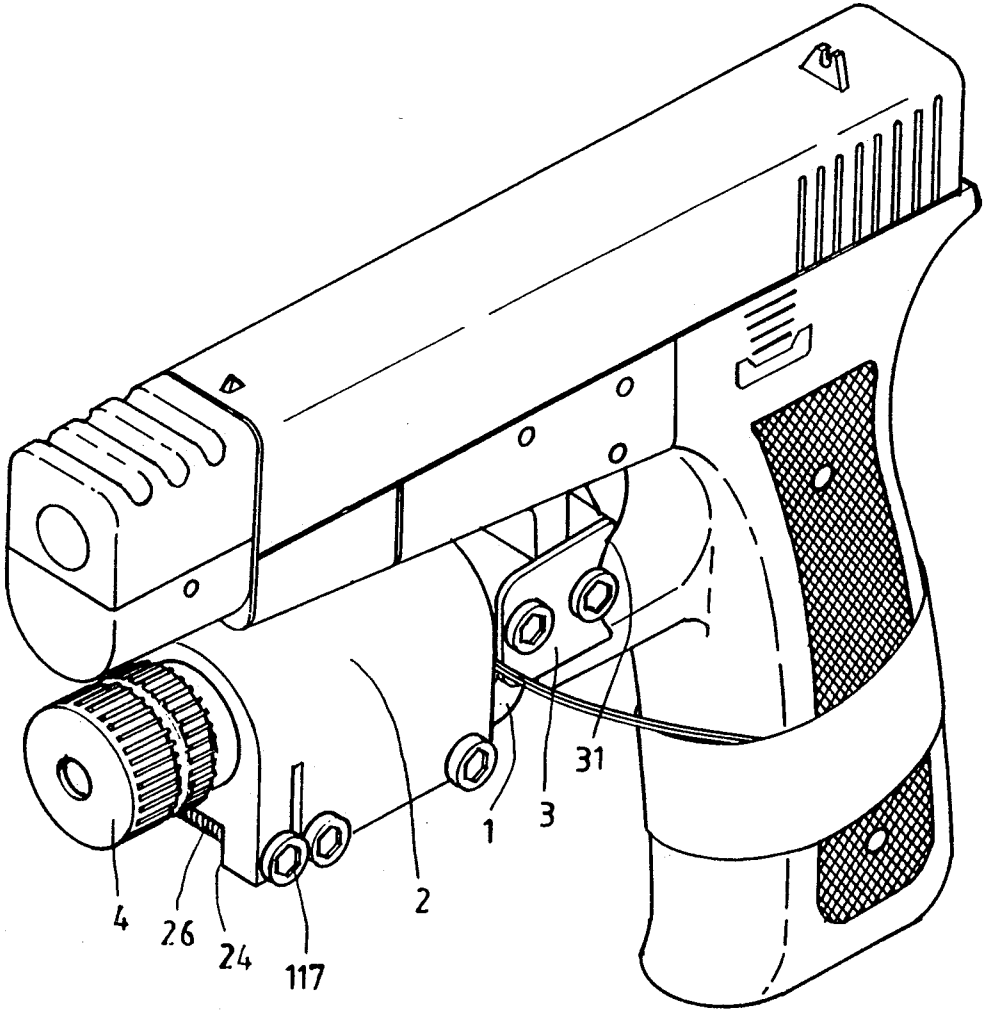
FIG. 5 is another installed view showing the laser sight mount device turned upside-down and then fastened to the gun.

Referring to FIG. 5, the laser sight mounting device may be fastened to the gun in a reverse direction with the channel 24 disposed at the bottom.

While only one embodiment of the present invention has been shown and described, it will be understood that various modifications and changes could be made without departing from the spirit and scope of the invention.

What is claimed is:

1. A laser sight mounting device comprising:

a mount for fastening to the trigger guard of a gun, said mount comprising a L-shaped frame 11, an arched block spaced from said L-shaped frame by a gap, and a connecting frame connected between said arched block and said L-shaped frame at one side, said L-shaped frame comprising a longer horizontal wall and a shorter vertical wall extended from said longer horizontal wall at one end at right angles, said longer horizontal wall having transverse screw holes through the width, said shorter vertical wall having two vertically spaced longitudinal screw holes through the width and a transverse screw hole through the thickness, said arched block having a transverse screw hole at one side;

a laser sight holder fastened to said mount for holding a laser sight, said laser sight holder comprising a hollow cylinder having a split front end controlled by an adjusting screw for mounting or dismounting a laser sight, a channel along the length of said hollow cylinder, which receive said longer horizontal wall of said mount, and spaced pairs of screw holes respectively and bilaterally connected to the transverse screw holes on said longer horizontal wall of said mount by screws; and a connecting plate connected between said arched block and said L-shaped frame to fasten said mount to the trigger guard of the gun, said connecting plate having two screw holes respectively connected to the transverse screw hole on said arched block and the transverse screw hole on said shorter vertical wall of said L-shaped frame by screws.

2. The laser sight mounting device of claim 1 wherein screw rods are respectively threaded into the vertically spaced screw holes on said shorter vertical wall of said L-shaped frame against the trigger guard of the gun on which the device is mounted, and locknuts are respectively mounted on the screw rods to tighten the screw rods in fixing said mount in position.

* * * * *